US006980121B2

(12) United States Patent
Bredow et al.

(10) Patent No.: US 6,980,121 B2
(45) Date of Patent: Dec. 27, 2005

(54) METHOD FOR OPERATING A RADIO REMOTE CONTROL SYSTEM

(75) Inventors: Wolfgang Bredow, Niefern-Öschelbronn (DE); Thomas Burchard, Pforzheim (DE); Thomas Haug, Ölbronn (DE)

(73) Assignee: Integrated Electronic Systems !SYS Consulting GmbH, Olbronn-Durrn (DE)

( * ) Notice: Subject to any disclaimer, the term of this patent is extended or adjusted under 35 U.S.C. 154(b) by 577 days.

(21) Appl. No.: 09/991,869

(22) Filed: Nov. 26, 2001

(65) Prior Publication Data

US 2002/0063634 A1 May 30, 2002

(30) Foreign Application Priority Data

Nov. 25, 2000 (DE) ..... 100 58 678

(51) Int. Cl.[7] ..... G08C 19/16
(52) U.S. Cl. ..... 340/825.69; 340/825.2; 318/16
(58) Field of Search ..... 340/825.69, 825.72, 340/825.21, 573.1, 542, 5.64; 318/16; 455/99; 341/173, 176

(56) References Cited

U.S. PATENT DOCUMENTS 3,263,141 A * 7/1966 Nicola ..... 318/16
3,774,217 A * 11/1973 Bonner et al. ..... 340/825.21
5,198,800 A * 3/1993 Tozawa et al. ..... 340/573.1
5,355,525 A * 10/1994 Lindmayer et al. ..... 455/99
5,365,225 A * 11/1994 Bachhuber ..... 340/5.26
5,420,568 A * 5/1995 Iida et al. ..... 340/542
5,517,189 A * 5/1996 Bachhuber et al. ..... 340/5.64
5,600,323 A * 2/1997 Boschini ..... 341/173
6,472,999 B1 * 10/2002 Lin ..... 340/825.69

FOREIGN PATENT DOCUMENTS

| | | | | |
|---|---|---|---|---|
| AU | 9719216 | * | 8/1997 | ..... G01S 3/48 |
| DE | 90 04 042 | * | 9/1990 | ..... E05B 65/34 |
| DE | 44 37 490 | | 6/1995 | |
| DE | 196 00 791 | | 7/1997 | |

* cited by examiner

*Primary Examiner*—Edwin C. Holloway, III
(74) *Attorney, Agent, or Firm*—Browdy and Neimark, PLLC

(57) ABSTRACT

A method for operating a radio remote control system having a transmitting unit and a receiving unit, composed of: following the termination of a radio connection between the transmitting unit and the receiving unit, modifying at least one transmitting or receiving parameter of the transmitting unit or the receiving unit with respect to a standard value in such a way that the establishment of a new radio connection is only possible if the distance between the transmitting unit and the receiving unit does not exceed a predetermined value; and following the establishment of a new radio contact with the modified parameter in effect, resetting the respective parameter to the standard value.

8 Claims, 1 Drawing Sheet

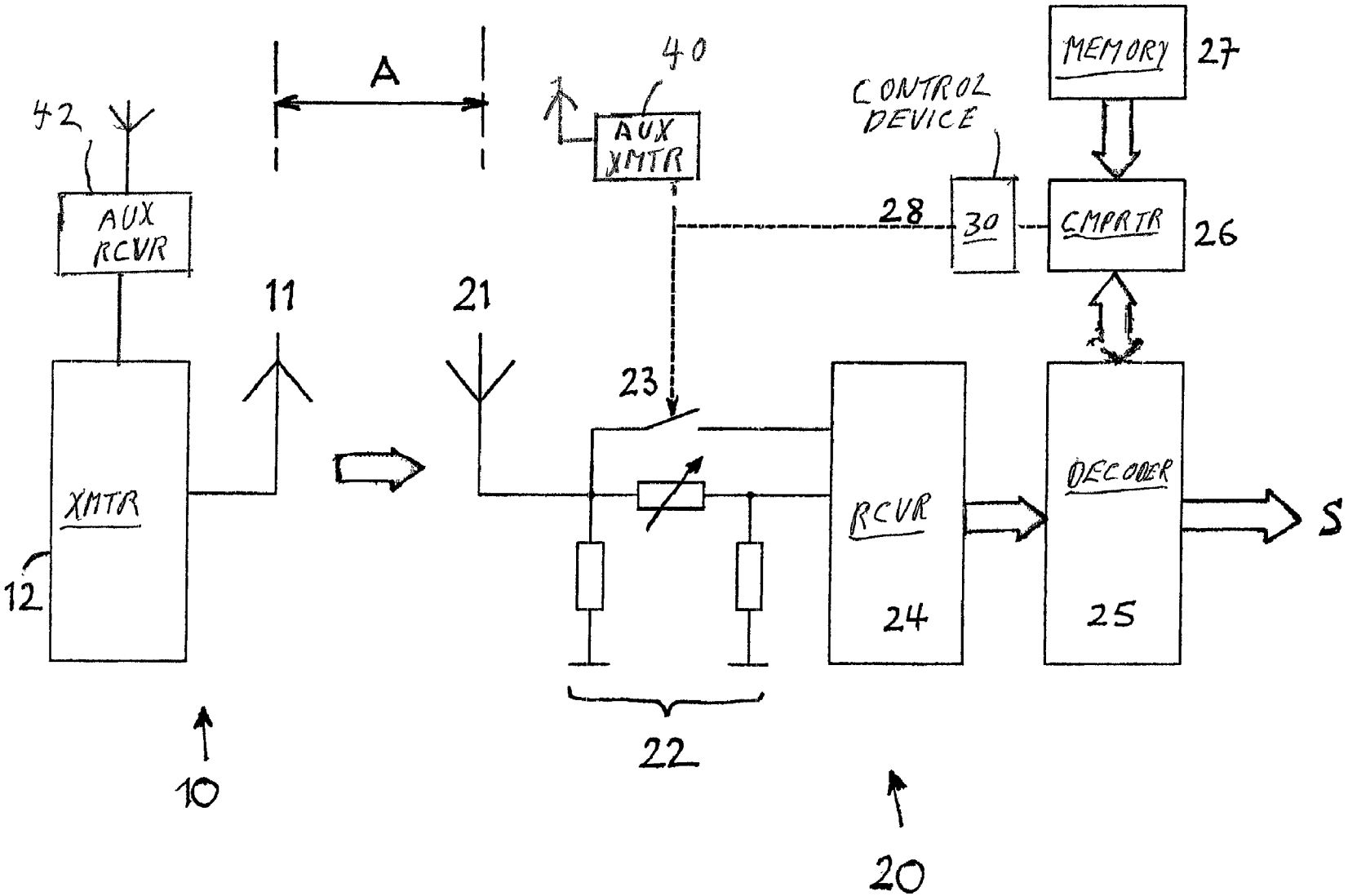
MEMORY
27
CMPRTR
26
DECODER
25
S
CONTROL DEVICE
30
28
RCVR
24
20
AUX XMTR
40
23
22
21
A
11
AUX RCVR
42
XMTR
12
10

METHOD FOR OPERATING A RADIO REMOTE CONTROL SYSTEM

BACKGROUND OF THE INVENTION

The invention relates to a method for operating a radio remote control system having a transmitting unit and a receiving unit.

The invention in particular relates to the control of industrial devices, for example cranes, robots, construction machinery or the like, but also to the control of motor vehicles of all types, in particular commercial vehicles, such as trucks or agricultural machinery, by means of which defined processing or work steps are performed. Often these are devices which make it necessary to insure that work steps are not performed mistakenly or erroneously, since a considerable safety risk to persons can arise because of this. In connection with what is of interest here, this means that it must be assured that the transmitters are not inadvertently or erroneously activated and that no control information is sent to the receiver which could possibly result in considerable erroneous functions and the risks connected therewith.

BRIEF SUMMARY OF THE INVENTION

It is therefore an object of the invention to operate a radio remote control system in such a way that this safety risk is considerably reduced.

In accordance with the invention, this object is attained, in a system as described above, by a method that includes:

following the termination of a radio connection between the transmitting unit and the receiving unit, modifying at least one transmitting or receiving parameter of the transmitting unit or the receiving unit with respect to a standard value in such a way that the establishment of a new radio connection is only possible if the distance between the transmitting unit and the receiving unit does not exceed a predetermined value; and following the establishment of a new radio contact with the modified parameter in effect, resetting the respective parameter to the standard value.

Thus, when establishing a radio connection according to the invention, a control can be performed only if a minimum distance is maintained between the transmitter and the receiver. This minimum distance can be adjusted for the individual work conditions and types of industrial devices, for example in such a way that a radio connection can only be established when a visual distance exists between the operator and the device that is to be operated and that is provided with the receiver. After each shut-down of the transmitter, or after the received signal falls below a first preset threshold (S1), a routine is triggered, at the end of which the transmitter output, for example, and/or of the receiving sensitivity of the transmitter and/or receiver, is reduced, with the result that an activation of a radio connection can only take place if the received signal exceeds a second preset threshold (S2), or only if a signal is "recognized" by the receiver in another way. This will only occur if the distance between the transmitter and the receiver has reached or fallen below the desired minimum value, so that in individual cases, for example, a visual contact between the operator and the device to be controlled is assured. If this recognition has taken place, the modified parameters (for example sensitivity/amplification factors) in the transmitter and/or the receiver are again set to their normal values, so that from then on the customary evaluation of the received signals containing control information for the device to be controlled can take place.

BRIEF DESCRIPTION OF THE DRAWING

A preferred embodiment of a device for executing the method in accordance with the invention is shown in the form of a block diagram in the FIGURE.

DETAILED DESCRIPTION OF THE INVENTION

The FIGURE shows a radio remote control system, constituted by a transmitting unit 10 composed of a transmitting antenna 11 and a transmitter 12. The system is further composed of a receiving unit 20 that includes a receiving antenna 21 and other components to be described below. A signal containing control information is transmitted from transmitting antenna 11 to receiving antenna 21, and from there reaches an HF receiving unit 24 in receiving unit 20.

In many radio remote control systems, the transmitted information consists of a sequence of packets, in each of which a first section contains the useful signal and a second section contains a few bits which, as a rule, constitute a defined pattern used by the receiver for acknowledgement and synchronization purposes. Signals arriving at receiving antenna 21 are conducted via an adjustable attenuation member 22 to receiving device 24 and are then decoded in a decoding device 25. The decoded signals are passed on to a comparator 26, in which the bit pattern of the second section of each packet is compared with a preset bit pattern stored in a memory 27. Only if a predetermined degree of agreement between the received and decoded bit pattern on the one hand, and the preset bit pattern on the other hand has been established, a control signal S for the industrial device to be controlled is generated, as indicated by the arrow.

For the application of the method of the invention, use is made of the fact that with a decreasing signal strength recognition of the bit pattern in the transmitted packet becomes more and more unreliable and finally falls below a predetermined "recognition level".

At the end of a radio connection, the invention first provides that a switch 23, which bridges attenuation member 22 upstream of HF receiving device 24, is placed into its open position by a signal applied via a control line 28 from a reception control device 30. The state existing prior to the establishment of a new radio connection is therefore represented in the drawing.

If now, following the switch-on of the components provided in the transmitter, new packets are transmitted from the transmitting unit 10 to the receiving unit 20, their quality is "degraded" by the adjustable damping produced by attenuation member 22 in such a way that, in the course of the subsequent comparison of the received bit pattern with the preset bit pattern, the recognition level is no longer achieved. As a result, transmitted packets are rejected as being invalid and therefore no control signal S for the industrial device to be controlled is generated. Only when the distance A between the two antennas 11 and 21 falls below a defined amount does the received amplitude of the transmitted signal become sufficiently strong, i.e. exceed threshold S2, that, despite the attenuation by the attenuation member 22, that the received bit patterns of the packets agree within preset limits with the test bit pattern and are therefore recognized as being valid. After a predeterminable number of such packets are recognized as being valid, the switch 23 is closed by a signal generated by device 30 and applied to control line 28, so that the attenuation member 22 is bridged, or shunted, and deactivated and normal transmitting operations are established.

Following the termination of the radio contact, either by switching off the transmitter, or because the transmission strength falls below switching threshold S1, the lack of bit pattern agreement is again detected in the comparator 26, the switch 23 is opened again via the control line 28 and the attenuation member 22 is activated, so that the radio connection cycle is terminated.

Control device 30 can control operation of switch 23 according to procedures that are known in the art. For example, when switch 23 is open and receiving unit 10 is turned on, comparator 26 continues to monitor incoming signals. Each time a predetermined degree of agreement is detected between the decoded bit pattern of a received packet and the preset bit pattern, a recognition signal is supplied to control device 30. Given that signal packets are transmitted at a fixed repetition rate, if a given number of recognition signals are supplied to control device 30 at a rate corresponding to the fixed repetition rate, control device 30 applies to line 28 a control signal to close switch 23. Switch 23 is maintained closed until one or selected number of recognition signals are not supplied to control device 30 at the fixed repetition rate, in which case the signal applied to line 28 causes switch 23 to open. Control device 30 then continues to monitor the output of comparator 26 until a sufficient number of recognition signals are supplied to once again cause switch 23 to be closed.

The invention can also be implemented by varying the transmitting power in response to the level of signals received by receiving unit 20. For example, the signal on line 28 can be supplied to an auxiliary transmitting device 40 incorporated into receiving unit 20 to control transmission of a control signal to an auxiliary receiving device 42 incorporated into transmitting unit 10. The signal received by device 42 can then be used to vary the transmitting power of unit 10.

The components represented in the drawing are merely intended for illustrating the method in accordance with the invention and can be realized by means of hardware and software in various ways.

This application relates to subject matter disclosed in German Application Number 100 58678.3, filed on Nov. 25, 2000, the disclosure of which is incorporated herein by reference.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

What is claimed is:

1. A method for operating a radio remote control system having a transmitting unit and a receiving unit, comprising:

following the termination of a radio connection between the transmitting unit and the receiving unit, modifying at least one transmitting or receiving parameter of the transmitting unit or the receiving unit with respect to a standard value in such a way that the establishment of a new radio connection is only possible if the distance between the transmitting unit and the receiving unit does not exceed a predetermined value;

for establishing a new radio connection, transmitting information composed of a sequence of packets each having a section with a defined bit pattern for testing purposes, comparing, in the receiving unit, the defined bit patterns with a stored bit pattern, and establishing the new radio connection and causing the receiving unit to generate a control signal only if the comparing step indicates correspondence between the defined bit pattern and the stored bit pattern; and following the establishment of the new radio connection with the modified parameter in effect, resetting the respective parameter to the standard value.

2. The method in accordance with claim 1, wherein one of said steps of modifying and resetting takes place in response to correspondence or noncorrespondence of the received bit sequence with the stored bit sequence.

3. The method in accordance with claim 1, wherein the at least one parameter is the transmitting output of the transmitting unit or the receiving sensitivity of the receiving unit.

4. The method in accordance with claim 3, wherein the parameter is the amplification of an amplification stage of the transmitting unit.

5. The method in accordance with claim 3, wherein the parameter is the receiving sensitivity of the receiving unit and said steps of modifying and resetting comprise switching a switchable attenuation member of the receiving unit.

6. The method in accordance with claim 5, wherein said step of modifying comprises reducing the transmission output of the transmitting unit or the receiving sensitivity of the receiving unit when the transmitting output of the transmitting unit during an existing radio connection falls below a first switching threshold (S1) over a defined period of time.

7. The method in accordance with claim 5, wherein said step of resetting comprising restoring the transmission output of the transmitting unit or the receiving sensitivity of the receiving unit to the standard value when the power of a signal received by the receiving unit from the transmitting unit exceeds a second switching threshold (S2).

8. The method in accordance with claim 1, wherein said remote control system is part of an industrial device.

* * * * *